US007942783B2

(12) United States Patent
Ochi et al.

(10) Patent No.: US 7,942,783 B2
(45) Date of Patent: May 17, 2011

(54) EXERCISE AID DEVICE

(75) Inventors: Kazuhiro Ochi, Osaka (JP); Takahisa Ozawa, Hikone (JP); Youichi Shinomiya, Ibaraki (JP)

(73) Assignee: Panasonic Electric Works, Ltd., Kadoma (JP)

( * ) Notice: Subject to any disclaimer, the term of this patent is extended or adjusted under 35 U.S.C. 154(b) by 159 days.

(21) Appl. No.: 11/658,351

(22) PCT Filed: Jul. 21, 2005

(86) PCT No.: PCT/JP2005/013369

§ 371 (c)(1), (2), (4) Date: Jan. 24, 2007

(87) PCT Pub. No.: WO2006/011408

PCT Pub. Date: Feb. 2, 2006

(65) Prior Publication Data

US 2008/0312040 A1 Dec. 18, 2008

(30) Foreign Application Priority Data

Jul. 27, 2004 (JP) ..... 2004-219323

(51) Int. Cl.
*A63B 71/00* (2006.01)

(52) U.S. Cl. ..... 482/8; 482/1

(58) Field of Classification Search ..... 482/1–9, 482/51, 79, 80, 146; 472/95, 97, 100; 434/247
See application file for complete search history.

(56) References Cited

U.S. PATENT DOCUMENTS 4,988,300 A * 1/1991 Yamaguchi et al. ..... 434/247
5,419,752 A * 5/1995 James et al. ..... 601/5
5,569,121 A * 10/1996 Sellier ..... 482/5
(Continued)

FOREIGN PATENT DOCUMENTS

CA 2 292 553 A1 10/1999
(Continued)

OTHER PUBLICATIONS

Notification of Reason(s) for Refusal mailed Jun. 23, 2009, issued on the Japanese application No. 2005-154675 and the English translation thereof.

*Primary Examiner* — Loan Thanh
*Assistant Examiner* — Shila Abyaneh
(74) *Attorney, Agent, or Firm* — Edwards Angell Palmer & Dodge LLP

(57) ABSTRACT

An exercise aid device has a hip supporting member movable relative to a base, footrests movable relative to the base, drive means for driving the hip supporting member, body constitution estimating unit for estimating at least one of fat mass and muscle mass of a user, and a controller for the drive means. The controller controls the drive means such that a load acting on a femoral region by own weight of the user supported on the hip supporting member changes according to a relative positional displacement between the user's toe and trochanter major, the positional displacement is allowed in a direction of flexion and extension of knee joint of the user, and an angle of the knee joint is maintained substantially constant. In addition, since the controller controls the drive means by use of an output of the body constitution estimating unit, it is possible to provide an exercise with less burden to the knee joint and a suitable strength for the user.

15 Claims, 9 Drawing Sheets

U.S. PATENT DOCUMENTS

| | | | | |
|---|---|---|---|---|
| 5,788,655 | A | 8/1998 | Yoshimura et al. | |
| 6,327,494 | B1 | 12/2001 | Sakai | |
| 7,130,680 | B2 * | 10/2006 | Kodama et al. | 600/547 |
| 7,402,142 | B2 * | 7/2008 | Kawai et al. | 600/587 |
| 2001/0027150 | A1 * | 10/2001 | Duke | 482/72 |
| 2002/0115536 | A1 * | 8/2002 | Hojo et al. | 482/51 |
| 2002/0125050 | A1 * | 9/2002 | Breed et al. | 177/136 |
| 2003/0045402 | A1 * | 3/2003 | Pyle | 482/51 |
| 2003/0204412 | A1 * | 10/2003 | Brier | 705/2 |
| 2004/0054298 | A1 | 3/2004 | Masuo et al. | |

FOREIGN PATENT DOCUMENTS

| | | | | |
|---|---|---|---|---|
| JP | 04-197278 | A | | 7/1992 |
| JP | 5-317456 | | | 12/1993 |
| JP | 07-289540 | A | | 11/1995 |
| JP | 8-308820 | | | 11/1996 |
| JP | 11-128197 | | | 5/1999 |
| JP | 11-155836 | | | 6/1999 |
| JP | 2000-41966 | | | 2/2000 |
| JP | 2000-342644 | A | | 12/2000 |
| JP | 2000342644 | A | * | 12/2000 |
| JP | 2002-113127 | A | | 4/2002 |
| JP | 2002113127 | A | * | 4/2002 |
| JP | 3086029 | | | 5/2002 |
| JP | 2002-303545 | A | | 10/2002 |
| JP | 2003070858 | A | * | 3/2003 |
| JP | 2003-339671 | | | 12/2003 |
| JP | 2004-344349 | A | | 12/2004 |
| JP | 2005-058733 | A | | 3/2005 |
| WO | WO 99/52602 | A1 | | 10/1999 |
| WO | WO 02/47548 | A1 | | 6/2002 |

* cited by examiner

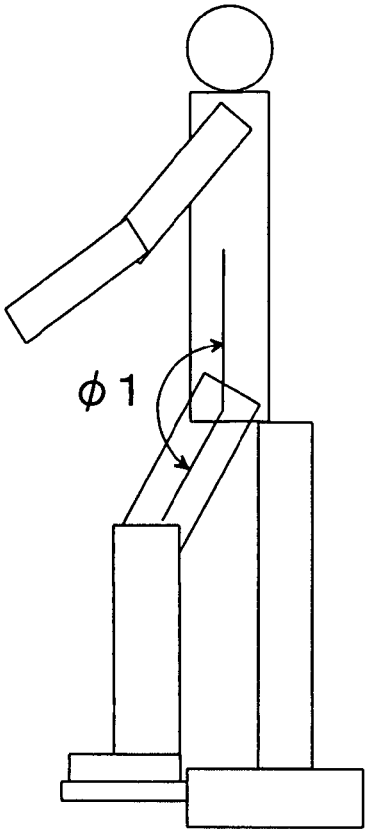
FIG. 6A
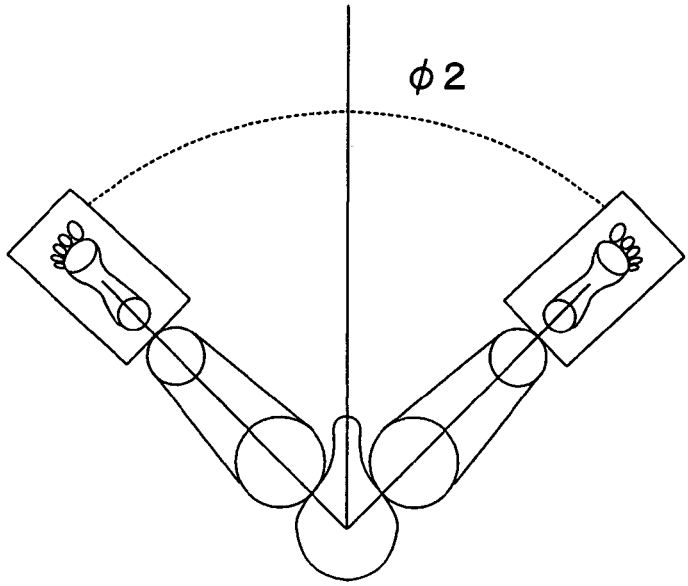
FIG. 6B
FIG. 7
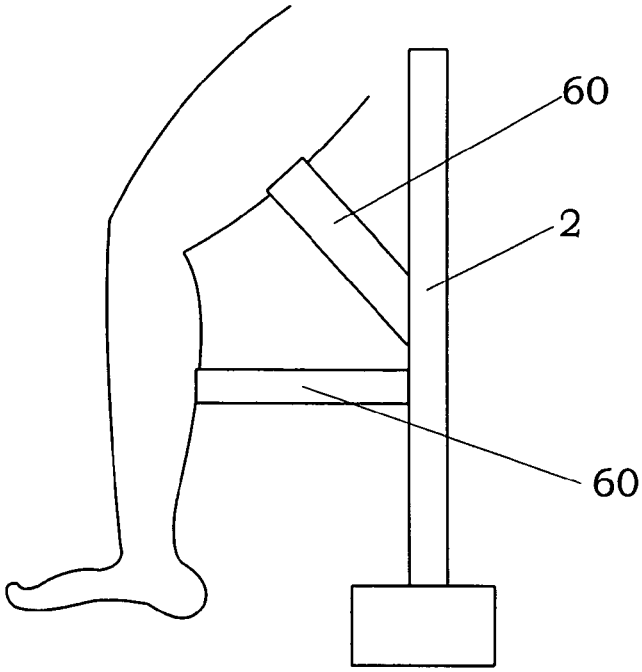

FIG. 10
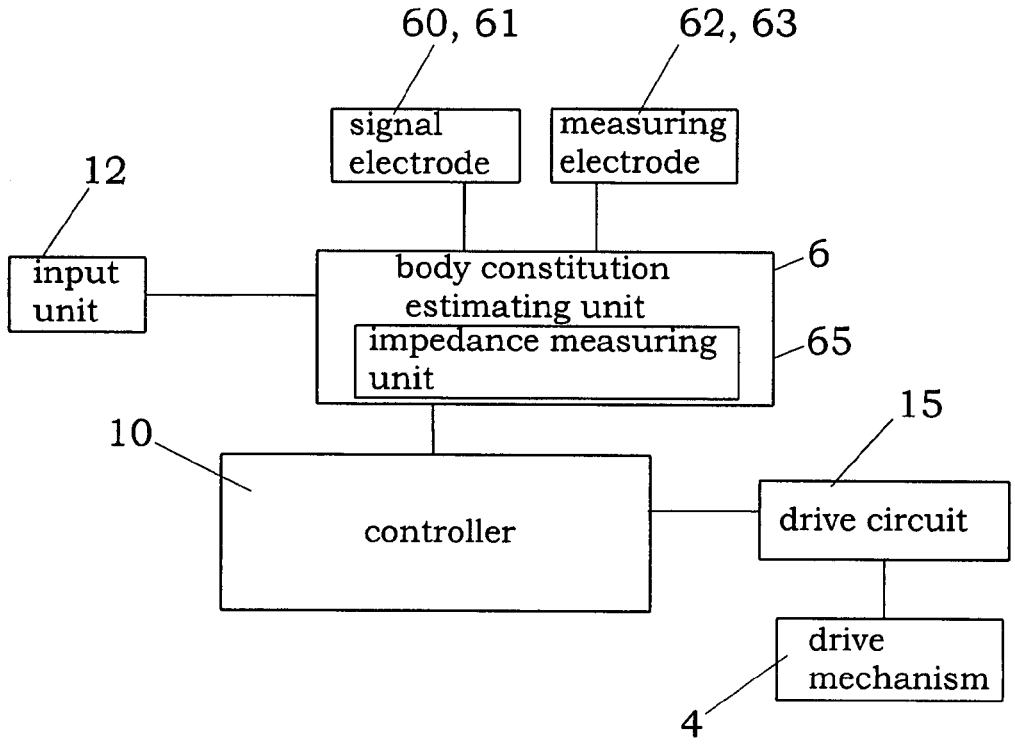
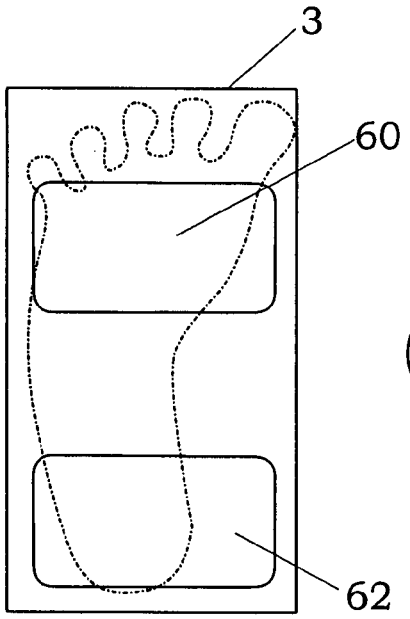
FIG. 11A
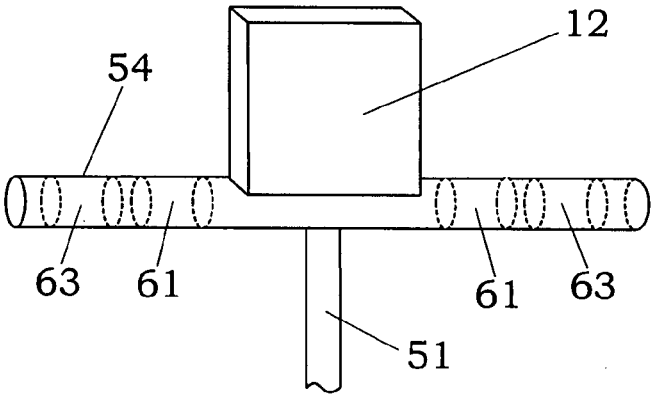
FIG. 11B

EXERCISE AID DEVICE

TECHNICAL FIELD

The present invention relates to an exercise aid device for providing an exercise with less burden to knee joint to a user in a sitting posture.

BACKGROUND ART

In the past, as an exercise aid device for providing a passive exercise stimulus to a user, it is known that there are a device for providing a simulated horse-riding exercise to the user sitting on a seat portion (for example, Japanese Patent Early Publication No. 11-155836), and a device for electrically driving pedals under the condition that the user's feet are placed on the pedals, thereby allowing the user to conduct a cycling exercise. It is said that these devices are useful to prevent life-style related diseases by providing aerobic exercise for reducing body fat to the user, and causing muscle contraction to facilitate sugar metabolism.

To improve the efficiency of sugar metabolism by muscle contraction, it is believed that it is effective to cause the muscle contraction at a large-volume muscle (particularly red muscle that contributes to aerobic exercise), and preferably muscles of femoral and back regions. However, it is often difficult to allow users with knee pain such as diabetic patients to conduct an effective exercise for causing the muscle contraction at the femoral and back portions due to the occurrence of knee pain or symptom exacerbation.

From these reasons, the device for providing the cycling exercise described above may place a heavy burden on the user's knee, and it is highly possible that pain is induced by the exercise. On the other hand, in the case of using the device for providing the simulated horse-riding exercise, since the user sits on the seat portion during the exercise, the burden on the knee can be reduced. However, this device is mainly intended to facilitate the muscle contraction at the trunk of the body such as the low back region. Therefore, it is expected to develop a device for effectively inducing the muscle contraction at the femoral region.

Additionally, in the case of doing the aerobic exercise, when an appropriate exercise amount is not set for each user, there causes a problem that the knee pain becomes worse due to excessive exercise, or a sufficient exercise effect cannot be obtained.

SUMMARY OF THE INVENTION

In view of the above problems, a primary concern of the present invention is to provide an exercise aid device for efficiently providing to the user a passive exercise stimulus with a muscle contraction of the femoral region, while reducing a burden on the user's knee.

That is, the exercise aid device of the present invention is characterized by comprising:

a base;

a supporting member movable relative to the base, which is configured to support a hip of a user;

a footrest movable relative to the base;

a drive means configured to drive at least one of the footrest and the supporting member; and a controller configured to control the drive means such that a load acting on a femoral region by own weight of the user supported on the supporting member changes according to a relative positional displacement between the user's toe and trochanter major, the positional displacement is allowed in a direction of flexion and extension of knee joint of the user, and an angle of the knee joint is maintained substantially constant.

According to this configuration, it is possible to efficiently provide the passive exercise stimulus, which is suitable to induce a muscle contraction at the femoral region of the user with deterioration in exercise function due to muscle weakness or knee pain, without placing a burden on the knee. Therefore, by continuously doing the exercise, an effect of preventing and improving lifestyle-related diseases are expected. Moreover, since the relative positional displacement between the user's toe and trochanter major is allowed (preferably limited) in the direction of flexion and extension of knee joint of the user, it is possible to safely provide the exercise with the muscle contraction of the leg portion without causing pain or symptom exacerbation even when the user has knee pain such as knee osteoarthritis.

In the exercise aid device described above, it is preferred that the drive means drives only the supporting member or the supporting member and the footrest in an interlocking manner. Particularly, when only the supporting member is driven, it is possible to achieve the exercise aid device with excellent cost performance.

It is also preferred that the exercise aid device described above comprises a body constitution estimating unit configured to estimate at least one of fat mass and muscle mass of the user, and the controller controls the drive means by use of an output of the body constitution estimating unit. In this case, at least one of fat mass and muscle mass of the user is estimated, and the operation speed and time of the supporting member can be appropriately controlled for the respective user according to estimation result.

As a preferred embodiment of the body constitution estimating unit, the exercise aid device comprises a grip which is held by the user, a pair of first electrodes disposed on the footrest, a pair of second electrodes provided on the grip, and an impedance measuring unit configured to measure a bioelectrical impedance of the user by detecting a potential difference between one of the first electrodes and one of the second electrodes, while applying a high frequency current between the other first electrode and the other second electrode, under the condition that the user's foot is placed on the footrest and the grip is held by the user, and wherein the body constitution estimating unit estimates at least one of fat mass and muscle mass of the user by use of an output of the impedance measuring unit.

To improve the estimation accuracy of fat mass and muscle mass by the body constitution estimating unit, it is preferred that the exercise aid device has a body weight input unit configured to input the user's body weight, and the body constitution estimating unit estimates at least one of fat mass and muscle mass of the user by use of the output of the impedance measuring unit and the user's body weight input by the body weight input unit.

As a further preferred embodiment of the present invention, the exercise aid device further comprises a body information input unit configured to input body weight and body height of the user, and an energy expenditure operation unit configured to calculate one of an energy expenditure per unit time of the user during exercise and a target energy expenditure per unit time of the user by use of an output of the body constitution estimating unit and the user's body weight and body height input by the body information input unit, and the controller controls the drive means according to an output of the energy expenditure operation unit.

In addition, it is preferred that the exercise aid device has a load sensor configured to detect a load acting on the footrest, and a body weight estimating unit configured to estimate the user's body weight by use of an output of the load sensor, and the body constitution estimating unit estimates at least one of fat mass and muscle mass of the user by use of outputs of the impedance measuring unit and the body weight estimating unit. Alternatively, it is preferred that the supporting member is length-adjustable in a height direction, and the exercise aid device comprises a distance sensor configured to detect the length of the supporting member in the height direction, and a body height estimating unit configured to estimate the user's body height by use of an output of the distance sensor, and the body constitution estimating unit estimates at least one of fat mass and muscle mass of the user by use of outputs of the impedance measuring unit and the body height estimating unit. In these cases, since the body information peculiar to the user such as body weight and body height can be considered in addition to the output of the impedance measuring unit, it is possible to further improve the estimation accuracy of fat mass and muscle mass by the body constitution estimating unit.

Additionally, it is preferred that the exercise aid device further comprises a memory configured to record a change in at least one of fat mass and muscle mass of the user, and an evaluation unit configured to evaluate exercise effects according to the change recorded in the memory, and the controller controls the drive means by use of an output of the evaluation unit.

As the exercise aid device according to a further preferred embodiment of the present invention, the exercise aid device comprises a memory configured to record a plurality of exercise programs by biological profile, and an input unit configured to input the user's biological profile, and the controller reads out from the memory one of the exercise programs which corresponds to the user's biological profile input by the input unit, and controls the drive means according to the read-out exercise program.

As the exercise aid device according to another preferred embodiment of the present invention, this exercise aid device further comprises a load sensor configured to detect a load acting on the footrest, and an operation unit configured to estimate a force acting on the knee joint of the user by use of an output of the load sensor, and the controller controls the drive means (e.g., an operation speed of the drive means such as change rate in inclination angle of the supporting member) in a real-time manner such that the force estimated by the operation unit is within a predetermined range. In this case, since the force the acting on the user's knee is estimated according to the load acting on the footrest to control the drive means, it is possible to monitor the exercise provided to the user in a real-time manner, and prevent that an excessive force acts on the user's knee. From the viewpoint of safety, it is particularly preferred that the drive means is stopped when the force estimated by the operation unit exceeds a predetermined upper-limit value. In addition, when the force acting on the knee joint is displayed to the user through a display means, the user can receive an appropriate exercise aid in a relaxed state with a sense of safety.

Further characteristics of the present invention and advantages brought thereby will become more apparent from the best mode for carrying out the invention described below.

BRIEF EXPLANATION OF THE DRAWINGS

FIGS. 6A and 6B are schematic views showing a posture of the user sitting on the exercise aid device;

FIG. 7 is a schematic view of an auxiliary support of the exercise aid device;

FIG. 10 is a block diagram of the same exercise aid device;

FIGS. 11A and 11B are diagrams showing electrode arrangements on a footrest and a grip;

BEST MODE FOR CARRYING OUT THE INVENTION

Exercise aid devices of the present invention are explained below in detail according to preferred embodiments.

First Embodiment

Figure 1:
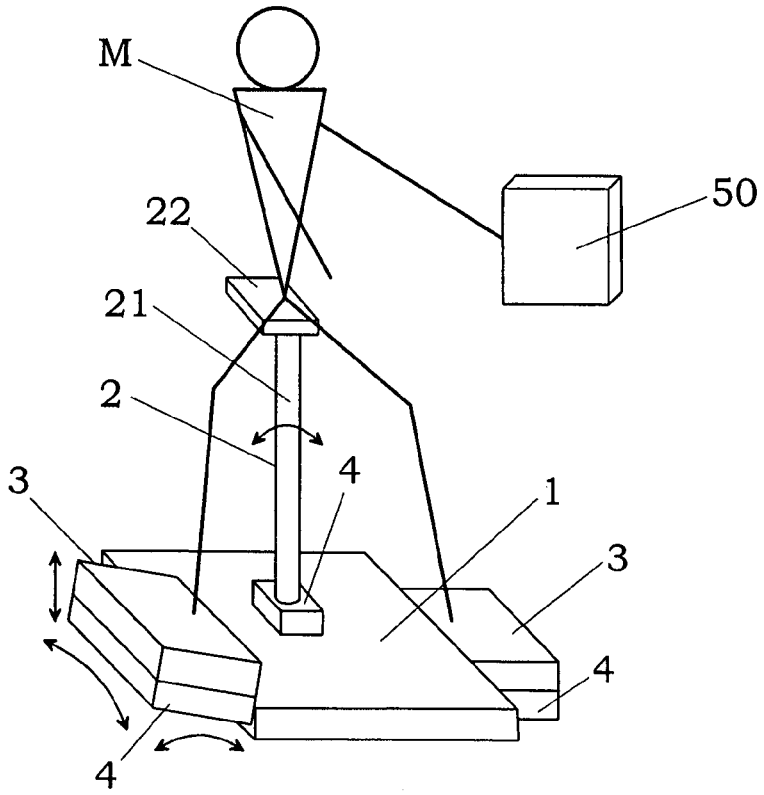
FIG. 1 is a schematic perspective view of an exercise aid device according to a first embodiment of the present invention.
Figure 2:
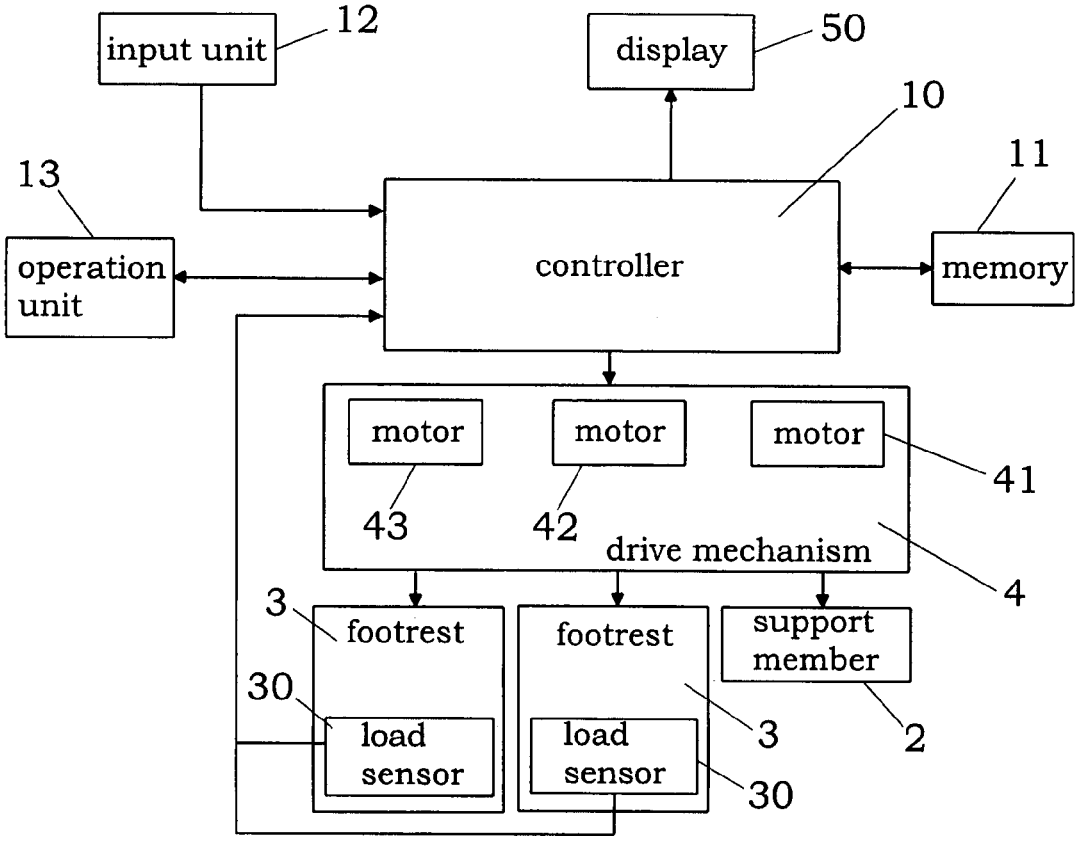
FIG. 2 is a block diagram of the exercise aid device.

As shown in FIGS. 1 and 2, an exercise aid device of the present embodiment is mainly formed with a base 1 located on a floor, a supporting member 2 for supporting a hip of a user M, a pair of footrests 3 for placing the user's feet thereon, a drive mechanism 4 for driving the supporting member 2 and the footrests 3, and a controller 10 for the drive mechanism 4. In FIG. 1, the numeral 50 designates a display for showing exercise conditions and biological information of the user.

The supporting member 2 is composed of a post 21 and a saddle 22 provided at the upper end of the post 21 to support the user's hip. The post 21 is supported at its lower end to be inclinable relative to the base 1 by the drive mechanism 4. That is, an output of a motor 41 as a drive means is transmitted to the supporting member 2 through the drive mechanism 4 to provide a reciprocating oscillating motion of the post 21 between an upright posture and an inclined posture.

As shown in FIG. 1, the supporting member 2 can be inclined within a plane including the saddle and the femoral region of the user under the condition that the user M is sitting on the saddle 22 with legs apart. That is, when the supporting member 2 is inclined relative to the base 1, a force substantially acts on the knee joint in only a direction of flexion and extension with no lateral force acting on the knee joint. In the present embodiment, a length of the post 21 is adjustable such that a knee angle of the user is set to a desired angle under the condition that the user sits on the saddle 22, and places the feet on the footrests 3. If necessary, a means of expanding and contracting the post 21 may be incorporated in the drive mechanism 4.

The footrests 3 are supported to be movable relative to the base 1 in the up and down direction through the drive mechanism 4. That is, a height position of the footrest 3 relative to the base 1 can be adjusted according to the inclination angle of the supporting member 2 relative to the base 1 such that an angle of knee joint of the user does not change when the supporting member 2 is inclined relative to the base 1. In addition, the footrests 3 are supported through the drive mechanism 4 to be inclinable relative to the base 1. FIG. 1 shows that the footrest is inclinable in the left and right direction. In the present embodiment, the inclination of the footrest 3 includes the case that the footplate is inclinable relative to the base in the back and forth direction connecting between toe and heel. For example, a shearing force acting on the knee joint can be changed by changing the inclination angle of the footplate in the back and forth direction. In addition, if necessary, the footrest may be rotatable about an axis orthogonal to the top surface of the footrest 3. The user can place the feet at required positions on the footrests 3 by reference to appropriate marks provided thereon. In addition, each of the footrests 3 has a load sensor 30 for detecting the load applied to the footrest by the user's foot.

In the present embodiment, to control the inclination angle of the left and right footrests 3 relative to the base 1 in a real-time manner, two motors 42, 43 for separately adjusting the inclination angles of the footrests 3 are used. In addition, the motor 41 for tilting the supporting member 2 is also used to move the footrests 3 in the up and down direction. Means for moving the footrests 3 is not limited to the motors. For example, an accordion device having the capability of moving the footrests up and down by use of air pressure is available. Alternatively, the footrests may be supported to be movable relative to the base by use of an elastic member such as spring with a required spring constant to obtain the equivalent effect.

The controller 10 is mainly composed of a microcomputer, which controls the motor 41 as a drive source for moving the supporting member 2 and the motors 42, 43 as drive sources for moving the footrests 3 such that a load acting on the femoral region by own weight of the user M supported on the supporting member 2 changes according to a relative positional displacement between the user's toe, and trochanter major, the positional displacement is substantially limited in a direction of flexion and extension of knee joint of the user, and an angle of the knee joint is maintained substantially constant. In the present embodiment, a movable range of the supporting member 2 is limited such that the flexion and extension of the knee joint is within a range of from the extension position to 45 degrees.

The exercise aid device of the present embodiment further comprises a memory 11 for storing time-series data as to rotational speed of each motor, which is set to obtain appropriate exercise stress, input unit 12 for inputting the user information such as gender, age, body weight and body height, and an operation unit 13 for estimating a force acting on the knee joint of the user according to an output of the load sensor 30 provided on the footrest 3. The controller 10 controls the motors (41 to 43) in a real-time manner so that the force estimated by the operation unit 13 is within a predetermined range. The information input from the input unit 12 is stored in the memory 11.

Figure 3A:
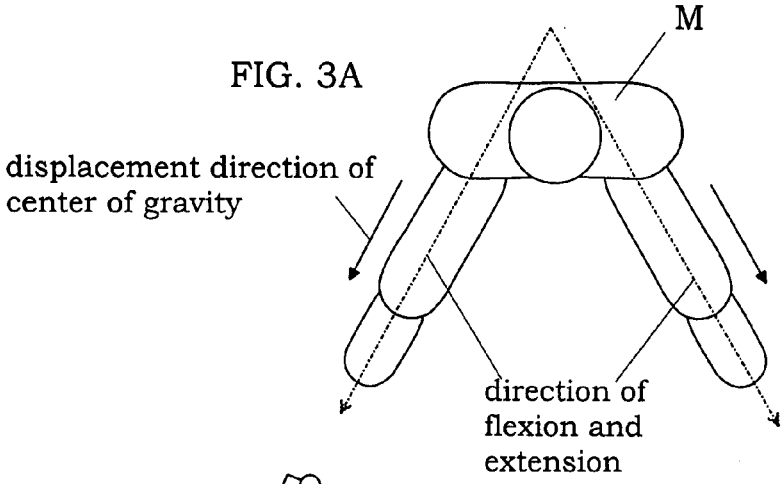
FIGS. 3A to 3E are operation explanatory diagrams of the exercise aid device.
Figure 3B:
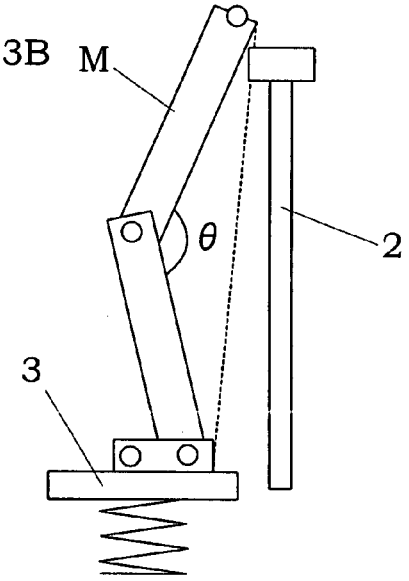
Figure 3C:
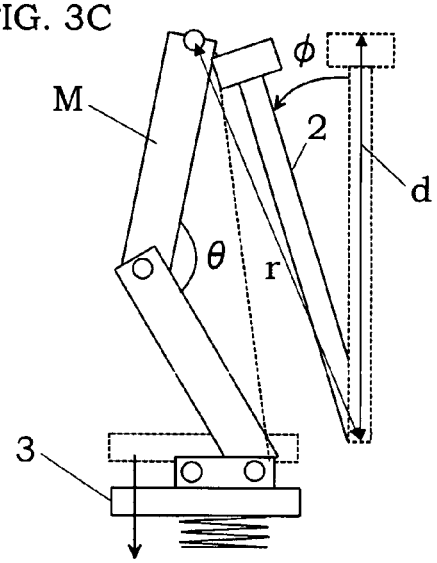
Figure 3D:
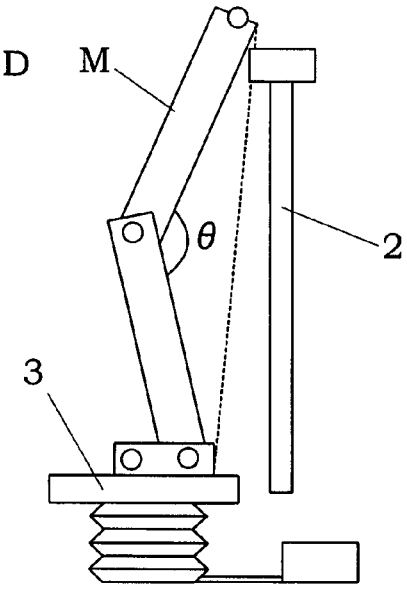
Figure 3E:
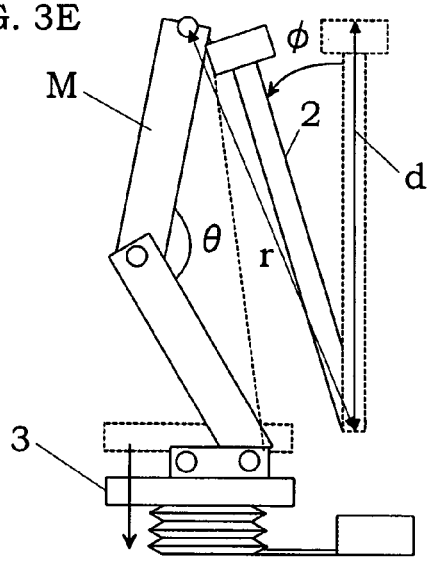

As shown in FIG. 3A, the exercise aid device described above is used under the condition that the user places the feet on the footrests 3, and sits on the saddle 22 with legs apart. The positional relation between the footrest 3 and the saddle 2 can be determined by adjusting at least one of the height position of the footrest 3 and the expansion and contraction length of the post 21. The supporting member 2 is oscillated between an upright posture of the post 21 relative to the base 1 and an inclined posture of the post in the forward right direction or the forward left direction such that a displacement direction of the center of gravity of the user is parallel with the direction of flexion and extension of the knee joint. In addition, during this oscillating motion, a bending angle θ of the knee joint of the user is maintained substantially constant. That is, since the footrest 3 is supported to be movable relative to the base 1 in the up and down direction by the drive mechanism 4, the footrest 3 is positioned, as shown in FIG. 3B or 3D, when the post 21 is in the substantially upright posture, and when the post 21 is in the inclined posture, the footrest 3 is positioned, as shown in FIG. 3C or 3E. Thus, by moving the footrest 3 downward, the bending angle θ of the knee joint can be maintained substantially constant. At this time, the footrest 3 may be supported by a spring having an appropriate spring coefficient, as shown in FIG. 3C, instead of moving the footplate by the drive source. Alternatively, as shown in FIG. 3E, the position of the footrest 3 may be changed by the drive source. In the case of tilting the supporting member 2 from the substantially upright posture toward one of the left and right footrests 3, only the footrest 3 positioned at the oscillating (tilting) side of the supporting member 2 is moved downward. Therefore, it is possible to efficiently give the load to the femoral region of one of the legs without changing the bending angle θ of the knee joint.

According to the exercise aid device of the present embodiment, the oscillating direction of the supporting member 2 (i.e., a direction the relative positional displacement between the user's foot on the footrest 3 and the trochanter major of the user) is restricted in the direction of flexion and extension of the knee joint, and the flexion and extension range (angular range) is also restricted. Therefore, even when the user has knee pain such as knee osteoarthritis, the user can conduct the exercise with a safe conscience, without inducing a twisting of the knee joint and causing bad influences such as pain or symptom exacerbation. In addition, since the footrest 2 is moved downward according to the inclination of the supporting member 2, it is possible to prevent a change in bending angle of the knee joint. As a result, a substantially isometric contraction of the leg muscle becomes possible, so that muscle metabolism is facilitated to improve insulin resistance without increasing the burden on the knee. Moreover, since the supporting member 2 and the footrests 3 are moved by the motors, it is not needed for the user to positively move the own body. In other words, it is enough for the user to passively conduct the exercise provided.

In addition, the exercise aid device of this embodiment is characterized by estimating the shearing force acting on the user's knee during the exercise in a real-time manner, and controlling motions of the supporting member 2 and the footrests 3 according to the estimation result. As an example, a method of estimating the shearing force acting on the knee by use of a rigid link model is explained referring to FIG. 4. The method of estimating the shearing force is not limited to this method. For example, another method using finite element analysis is also available.

Figure 4:
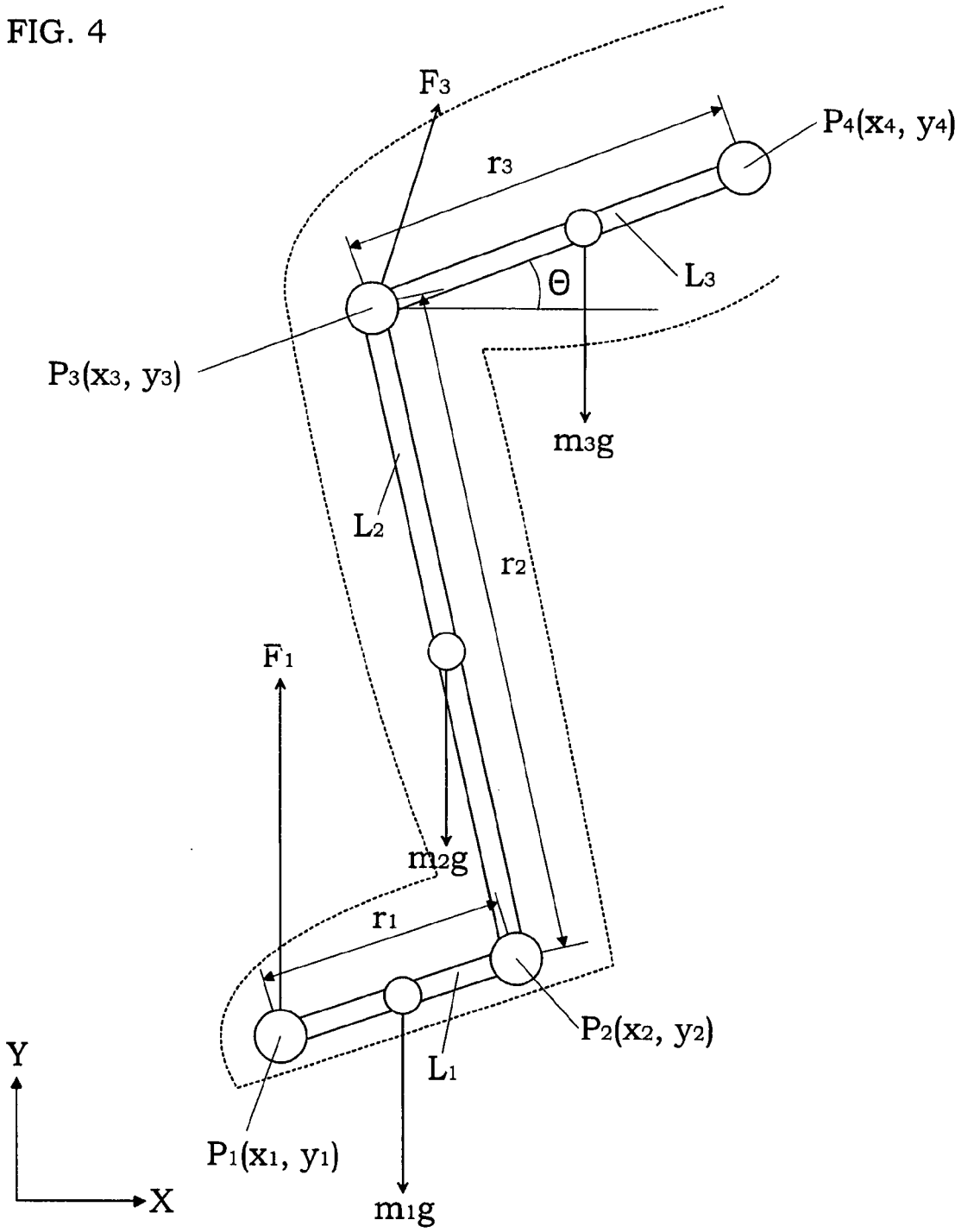
FIG. 4 is a diagram showing a link model for determining a shearing force acting on the user's knee.

In FIG. 4, "$L_1$" is a rigid link corresponding to a foot region. "$L_2$" is a rigid link corresponding to a lower-leg region. "$L_3$" is a rigid link corresponding to the femoral region. "$P_2$" is a supporting point corresponding to ankle joint. "$P_3$" is a supporting point corresponding to knee joint. In addition, "$r_1$", "$r_2$" and "$r_3$" are lengths of "$L_1$", "$L_2$" and "$L_3$", respectively. "$m_1$", "$m_2$" and "$m_3$" are weights of "$L_1$", "$L_2$" and "$L_3$", respectively. The lengths and weights of these links are determined from the user's body weight and body height according to anatomical information of the human body. By taking into account another parameters such as gender and age, they can be determined with higher accuracy.

In FIG. 4, a direction vertical to the top surface of the base 1 is defined as Y-axis direction, and the horizontal direction is defined as X-axis direction. Therefore, the flexion and extension movement of the knee joint of the user can be defined in the XY plane. In this coordinate system, the toe, the ankle joint, the knee joint and the trochanter major have coordinates $(x_1, y_1)$, $(x_2, y_2)$, $(x_3, y_3)$ and $(x_4, y_4)$, respectively. In addition, "$F_1$" designates a load (reactive force) detected by the load sensor 30 provided on the footrest. "$F_2$" designates a force acting on the ankle joint, and "$F_3$" designates a force acting on the knee joint. The angle "θ" is an inclination angle of the link "$L_3$" relative to the horizontal axis.

Under the above-described conditions, the shearing force Fs3 acting on the knee joint in the back and forth direction is represented by the following equation (1).

$$Fs3=F_3x\cdot\cos\theta+F_3y\cdot\sin\theta \quad (1)$$

$F_3x$ and $F_3y$ are represented by the following equations (2) and (3), respectively.

$$F_3x=F_2x+m_2\cdot(d^2x_2/dt^2) \quad (2)$$

$$F_3y=F_2-m_2g+m_2\cdot(d^2y_2/dt^2) \quad (3)$$

In addition, $F_2x$ and $F_2y$ are represented by the following equations (4) and (5), respectively.

$$F_2x=F_1x+m_1\cdot(d^2x/dt^2) \quad (4)$$

$$F_2y=F_1y-m_1g+m_1\cdot(d^2y_1/dt^2) \quad (5)$$

In the above, "g" is gravity acceleration, $F_1x$ and $F_1y$ are x- and y-direction components of the load detected by the load sensor, which can be determined according to the inclination angle of the footrest 3 relative to the base 1. In addition, $(d^2x_2/dt^2)$, $(d^2y_2/dt^2)$, $(d^2x_1/dt^2)$ and $(d^2y_1/dt^2)$ can be determined according to a change in positions of the toe and the ankle joint with respect to time. Similarly, the shearing force acting on the knee joint in a direction orthogonal to the back and forth direction (frontal plane direction) and the shearing force acting on the other joint can be calculated. These calculations are performed in the operation unit 13. The shearing force acting on the knee joint, which is determined by the operation unit 13, is useful to control the drive mechanism 4, as described later. The shearing force acting on the knee joint may be displayed on the display 50. For the easiness of explanation, the three rigid link model has been used in the above case. However, by using detailed settings according to actual anatomical data of the human body, the estimation accuracy can be further improved.

In addition, the positions of the ankle joint and the trochanter major can be determined as below. That is, in FIG. 3C, "Φ" is an inclination angle of the supporting member 2, and "d" is a radius of gyration of the supporting member 2. "r" is a distance between the trochanter major and a center of gyration of the supporting member 2. As a result, the coordinate (x, y) of the trochanter major is determined by the following equations.

$$x=r\cdot\sin\Phi$$

$$y=r\cdot(1-\cos\Phi)$$

The position of the ankle joint is obtained by determining a positional displacement of the footrest. In addition, when the positions of the ankle joint and the trochanter major are calculated, the angle of the knee joint of the user is determined according to previously stored measurement data as to the angle of the knee joint. As the supporting member is inclined, the corresponding footrest is moved downward such that the angle of the knee joint is maintained substantially constant. Therefore, the position of the knee joint can be also determined.

Figure 5:
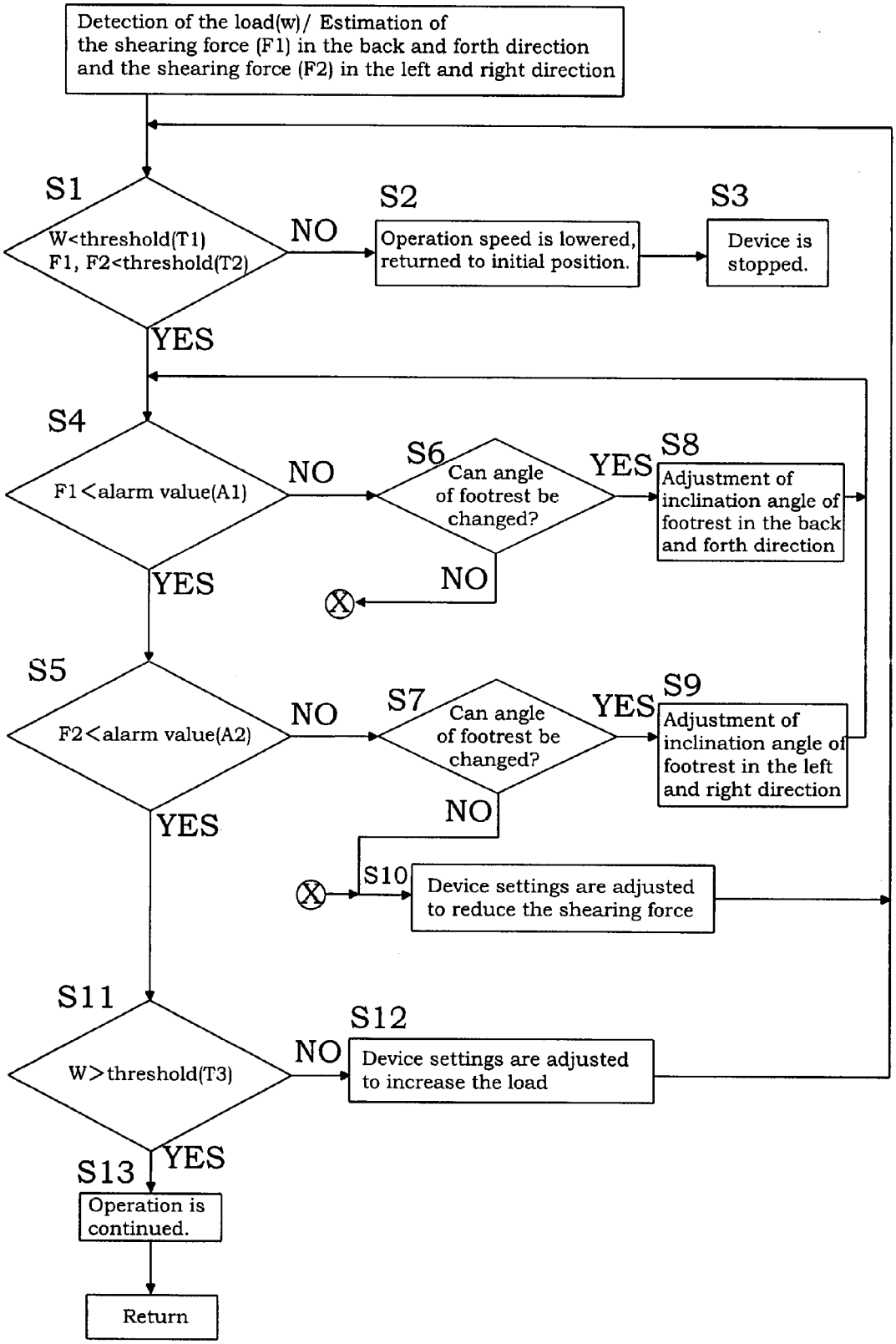
FIG. 5 is a flow chart showing an operation control of the exercise aid device.

Next, as an example, a method of controlling the exercise aid device according to the shearing force estimated by the above method is explained referring to FIG. 5. When body weight and body height of the user are input as the biological information of the user by the input unit 12, the motor is driven at a predetermined standard value by the controller 10. Next, the load (W) detected by the load sensor 30 is read in, and the shearing forces (F1, F2) acting on the knee joint are calculated by the above-described method. To further improve the accuracy, it is also preferred to detect the load applied to the supporting member 2 by the user's hip, and estimate the shearing forces by use of the detected load.

The estimated shearing forces (F1, F2) acting on the knee joint and the load (W) detected by the load sensor 30 are respectively compared with predetermined threshold values (T1, T2)(S1). When one of the shearing forces and the load exceeds the threshold value, the operation speed of the motor is lowered, the supporting member and the footrests are returned to initial positions (S2), and the motor operation is stopped (S3). In this manner, it is possible to prevent that an excessive load acts on the knee joint.

When both of the shearing forces and the load are not greater than the threshold values, the shearing force (F1) acting in the back and forth direction and the shearing force (F2) acting in the left and right direction are compared with alarm values (A1, A2), respectively (S4, S5). In this embodiment, large and small two threshold values are set with respect to each of the shearing forces. The large threshold value T2 means a limit value, and each of the smaller threshold values A1, A2 means an alarm value. The alarm value A1 for the shearing force acting in the back and forth direction is different from the alarm value A2 for the shearing force acting in the left and right direction. Even when the shearing force becomes greater than the alarm value, it is not needed to immediately stop the motions of the supporting member and the footrests. This value is a value showing that there is a fear that the user feels pain on the knee joint. When greater than this value, the drive means is controlled to reduce the shearing forces. For example, the burden on the knee can be reduced by changing the inclination of the footrest, the length of the supporting member, or a speed of tilting the supporting member. When the device is operated such that no force act on the knee joint in the left and right direction, the step S5 of comparing the shearing force (F2) acting in the left and right direction with the alarm value can be omitted.

When the shearing force exceeds the alarm value with respect to either one of the back and forth direction or the left and right direction (S6, S7), and the angle of the footrest 3 is within a changeable range, the inclination angle of the footrest 3 relative to the base 1 is changed (S8, S9). By changing the inclination angle of the footrest 3, a position of the center of gravity of the load acting on the user's sole and an acting direction of the load vary, so that the shearing force acting on the knee joint becomes changeable. In the case of changing the shearing force acting on the knee joint in the left and right direction, the footrest is designed to be inclinable in the left and right direction.

On the other hand, when the angle is not changeable, the drive means can be controlled to reduce the shearing force (S10). For example, when the shearing force reaches the alarm value, the motor is controlled to increase the inclination angle of the footrest 3 relative to the base 1 such that the heel is at a higher position than the toe. According to this manner, a tensile force acting on the knee joint by hamstrings can be increased than the tensile force caused by quadriceps muscles to thereby reduce the shearing force acting on the knee joint in the back and forth direction.

When both of the shearing force acting in the back and forth direction and the shearing force acting in the left and right direction are not greater than the alarm values, the load detected by the load sensor 30 is compared with a predetermined threshold value (T3)(S11). This threshold value (T3) is set to determine as to whether the load is acting on muscles in a degree of contributing to an improvement in diabetes. When not greater than the threshold value (T3), it is considered that the load to be applied to the user is lacking, so that the drive mechanism 4 is controlled to increase the load (S12). On the other hand, when the load detected by the load sensor is greater than the threshold value (T3), it is considered that an appropriate exercise stress is being applied to the user, so that the current operation of the motor is continued.

In the step 10, as another method of reducing the shearing force in the case that the angle of the footrest 3 is not changeable, the followings (1) to (3) can be exemplified.

(1) The drive mechanism is controlled to reduce angular change rates per time unit of the supporting member 1 and the footrest 3. In brief, angle changing speeds of the supporting member 2 and the footrest 3 are reduced.

(2) An angle Φ1 shown in FIG. 6A that is an angle of the femoral region relative to the trunk of the body, and an angle Φ2 shown in FIG. 6B that is an angle of the hip joint with legs apart are changed. By adjusting the angles Φ1 and Φ2, a degree of acting the load on the knee joint changes. Concretely speaking, the angles Φ1 and Φ2 can be changed by changing the length of the supporting member, the height position of the footrest 3 relative to the base 1, or a horizontal interval between the footrests. By reducing the length of the supporting member 2, the angle of the knee joint becomes small, and therefore the shearing force is reduced. In addition, when the supporting member 2 is tilted, a displacement distance of the user's hip becomes smaller, as compared with the case of adopting the supporting member 2 having a large length. Therefore, it is possible to reduce the force acting on the knee joint.

(3) As shown in FIG. 7, an auxiliary support 60 is used to support or tow the lower leg of the user. The auxiliary support 60 is integrally formed with the supporting member 2 to support or tow at least one of the foot, the lower leg and the femoral region. For example, the hardness is adjustable by controlling the internal air pressure, and it is hardened in the case of supporting or towing.

Figure 8:
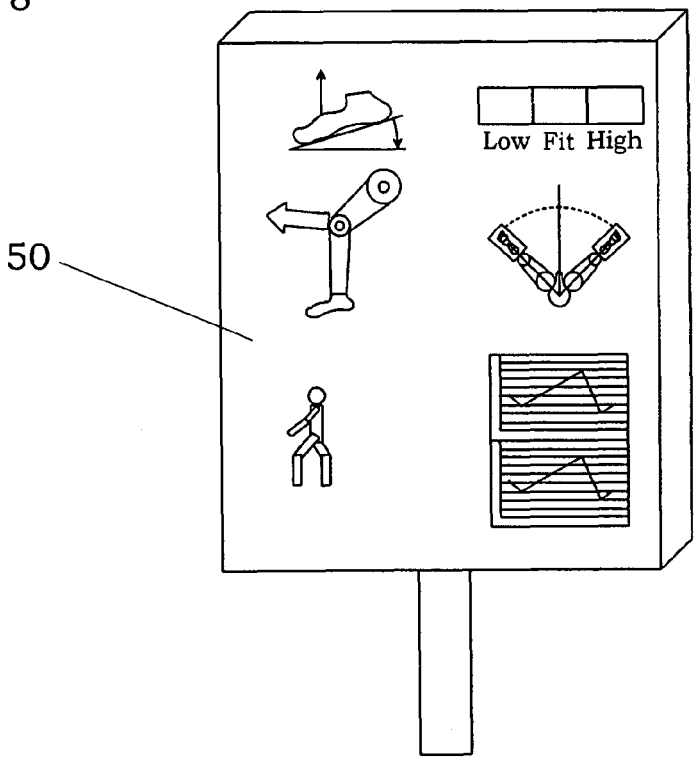
FIG. 8 is a schematic perspective view showing an example of a display of the exercise aid device.

As shown in FIG. 8, the display 50 is used to schematically show control amounts of the motors and the motions of the supporting member 2 and the footrests 3, a graph of the sharing force acting on the user's knee joint, which is estimated by the operation unit 13, and a change of the load detected by the load sensor 30 with respect to time. In addition, information for guiding the exercise may be displayed. Furthermore, it is preferred that data is transmitted to an expert at a remote location through communication means, and the expert's advise is given to the user through the display.

Second Embodiment

Figure 9:
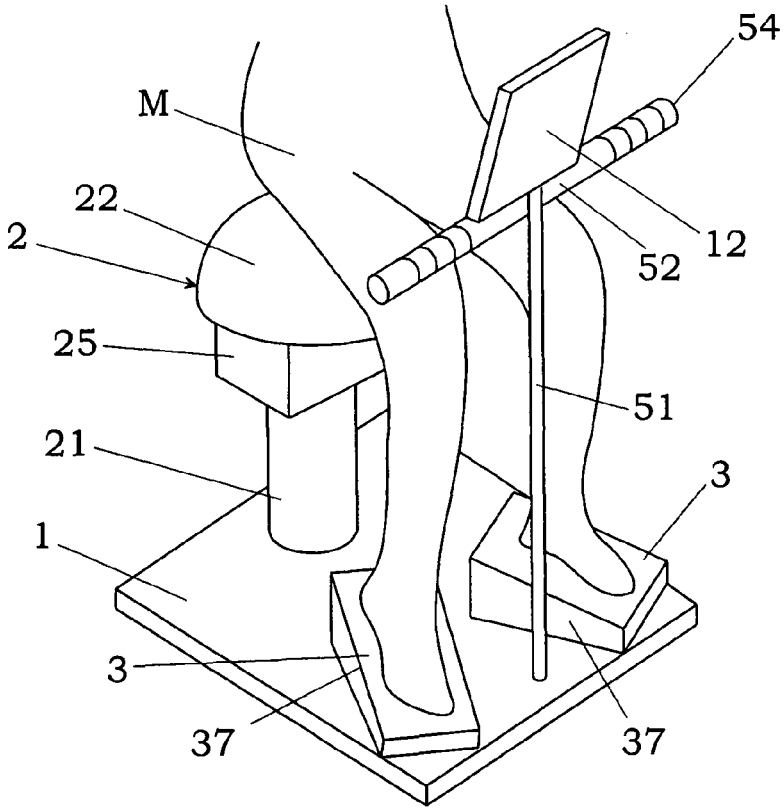
FIG. 9 is a schematic perspective view of an exercise aid device according to a second embodiment of the present invention.

As shown in FIGS. 9 and 10, an exercise aid device of this embodiment is mainly formed with a base 1 fixed on an installation surface such as a floor, a supporting member 2 for supporting a hip of a user M, a pair of footrests 3 for placing the user's feet thereon, a drive mechanism 4 for driving a saddle 22 of the supporting member 2 relative to the base 1, a body constitution estimating unit 6 for estimating fat mass of the user, and a controller 10 for controlling the drive mechanism 4 according to the estimation results.

The supporting member 2 is composed of a post 21 located on a top surface of the base 1, a box 25 for accommodating the drive mechanism 4 therein, and the saddle 25 for supporting the user's hip. To set a bending angle of knee joint to a required angle (e.g., 40 degrees), positions of the footrests 3 relative to the base 1 and an initial position (height position) of the saddle 25 are adjustable. For example, a gasket spring can be used to adjust the height position of the saddle 25. Alternatively, a conventional configuration for moving a bicycle saddle up and down may be used. In addition, the saddle 22 may be moved up and down by a motor. It is also preferred that a plurality of seat members having different heights are prepared, and an appropriate one of them is exchangeably used according to the user's body shape.

The respective footrest 3 is movable relative to the base 1 by use of an elastic member 37. A relationship between a load acting on the femoral region and a movable range of the supporting member 2 is previously determined, and the elastic member having an appropriate elastic coefficient is selected according to the relationship. By use of this footrest 3, it becomes possible to keep the angle of the knee joint substantially constant during the exercise. In the present embodiment, the footrest 3 is supported to be displaceable relative to the base 1 in the up and down direction through a spring and a pantograph-like mechanism that is expandable and contractable up and down. In addition, the footrest has a top surface inclining from the heel toward the toe. A motor may be used to move the footrest 3 up and down. To adjust an angle of ankle joint, that the inclination angle of the footplate in the forward and rearward direction, an inclination angle of the footplate in the left and right direction, or a rotation angle about a vertical direction of the footrest may be variable.

In FIG. 9, the numeral 51 designates a pole standing between the footrests 3. The numeral 52 designates a handle extending in the left and right direction at the top end of the pole. That is, the pole 51 and the handle 52 are configured in substantially a T shape. A pair of grips are provided at both end portions of the handle 52, which can be held by the user sitting on the saddle 22. The numeral 12 designates an input unit with touch panels, which is used to input the user's information such as body weight. The input unit also has a display for showing the information input by the user and an exercise menu. As described later, the grips 54 are mainly used when estimating the body constitution of the user, so they are not usually used during the exercise. However, it is useful for the user such as an elderly person or a feeble person to safely get on and off the supporting member 2.

The drive mechanism 4 has at least one motor as a drive source for the saddle 22 to change the inclination angle of the saddle 22. For example, by adopting a gear-crank mechanism or appropriately combining mechanical components such as links and cams, a top of the saddle 22 can be moved in a reciprocating manner between a horizontal position and an inclined position in a plane including the supporting member 2 and each of the footrests 3. According to this manner, it is possible to match the exercise direction with the direction of flexion and extension of the knee joint, and prevent that a force acts on the knee joint in left and right direction. When the inclination angle of the top of the saddle 22 is changed, the load acting on the femoral region of the user fluctuates, so that the load acting on the footrest 3 also increases and decreases to move the footrest 3 up and down. At this time, a relative distance between the user's hip supported by the saddle 22 and a sole of the user on the footrest 3 is kept substantially constant. Therefore, the bending angle of the knee joint undergoes only minimal changes. Consequently, an isometric contraction state is achieved to reduce the burden on the knee joint.

As shown in FIG. 10, the controller 10 is mainly composed of a microcomputer, and controls the drive mechanism 4 through a drive circuit 15. The drive circuit 15 is an interface between the controller and the drive mechanism 4, and supplies required electric power to the motor according to an output of the controller.

In the case of using the exercise aid device described above, the user places the feet on the footrests 3 such that the soles closely contact the footrests, and sits on the saddle 22. Under this condition, by changing the inclination angle of the top of the saddle, a magnitude of the load acting on the femoral region of the user can be changed. At this time, a relation of G11/G12>G21/G22 is realized, wherein "G11" is the load acting on the saddle 22, and "G12" is the load acting on the footrest 3 when the top of the saddle 22 is substantially parallel with a top of the base 1, and "G21" is the load acting on the saddle 22, and "G22" is the load acting on the footrest 3 when the top of the saddle 22 is inclined relative to the top of the base. Therefore, as the inclination of the saddle 22 increases, the user's posture becomes closer to a standing posture, and the load acting on the femoral region increases due to the user's own weight.

The most important feature of the present embodiment is to control the drive source by use of the fat mass of the user estimated by the body constitution estimating unit 6. That is, the exercise aid device of this embodiment is provided with a pair of first electrodes (60, 62) disposed on each of the footrests 3, as shown in FIG. 11A, two pairs of second electrodes (61, 63) mounted on the grips 54, as shown in FIG. 11B, and an impedance measuring unit 65 configured to measure a bioelectrical impedance of the user by detecting a potential difference between one (62) of the first electrodes and one (63) of the second electrodes, while applying a high frequency current between signal electrodes provided by the other first electrode (60) and the other second electrode (61), under the condition that the user put the feet on the footrests 3, and holds the grips. The body constitution estimating unit 6 estimates the fat mass of the user by use of an output of the impedance measuring unit 65. The estimated fat mass of the user is preferably shown on the display of the input unit 12.

In the past, it has been already utilized to determine body fat percentage of the user by measuring the bioelectrical impedance. To put it briefly, since fat in the body has a lower water content than other sites, the impedance increases as the fat amount in the body becomes larger. By use of this principle, the fat amount in the body can be estimated. In the case of measuring the impedance by use of plural electrode pairs, it is preferred that the high-frequency current applied between each electrode pair has a different frequency from that applied between the other electrode pair. For example, by measuring impedance between both hands, impedance between both feet, and impedance between hand and foot, and then subtracting the impedances between both hands and between both feet from the impedance between hand and foot, the impedance of the trunk of the body can be determined. Since there is a correlation between the fat amount and the impedance, the fat amount in the trunk of the body can be estimated according to the correlation. In addition, as the body fat amount decreases, it can be estimated that the muscle amount increases antithetically. Therefore, the muscle amount may be estimated by use of the measured body fat amount and the body weight as parameters.

To accurately estimate the fat mass or the muscle mass, body weight selected from the group of body weight, body height, age and gender of the user is preferably used as a bodily characteristic amount as well as the bioelectrical impedance. In the present embodiment, the user can input the body weight through the input unit 12. In addition, when the body height is used as an additional parameter, it is possible to further improve the estimation accuracy of the fat mass or the muscle mass. The controller 10 sets an appropriate exercise amount for each of the users according to the estimated fat mass or muscle mass of the user, and controls the drive mechanism 4.

Third Embodiment

Figure 12:
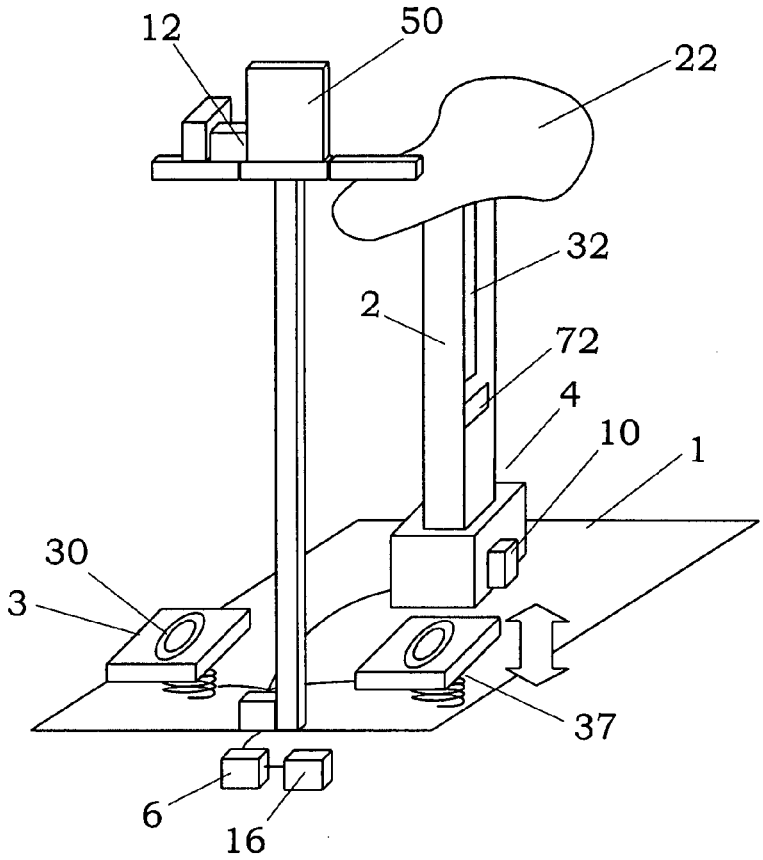
FIG. 12 is a schematic perspective view of an exercise aid device according to a third embodiment of the present invention.
Figure 13:
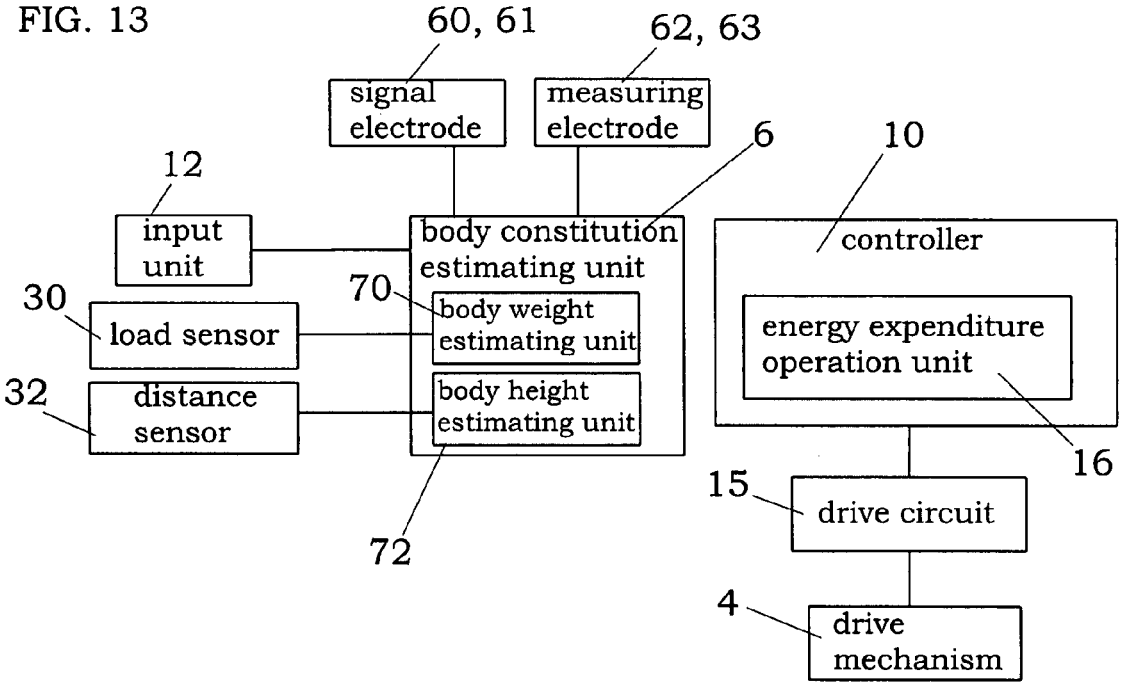
FIG. 13 is a block diagram of the exercise aid device.

As shown in FIGS. 12 and 13, an exercise aid device of this embodiment is characterized by comprising a body constitution estimating unit 6 composed of a body weight estimating unit 70 and a body height estimating unit 72 in placing of allowing the user to input body weight and body height through an input unit 12, an energy expenditure operation unit 16 for calculating a target energy expenditure per unit time of the user, and a controller 10 for controlling the drive mechanism 4 by use of an output of the energy expenditure operation unit 16. Therefore, other components are substantially the same as the second embodiment, and duplicate explanations are omitted.

The body weight estimating unit 70 calculates the user's body weight according to the output of the load sensor 30 located on each of the footrests 3. As the load sensor 30, for example, it is possible to use a load cell with piezoelectric element, or a device of detecting a tensile amount of a spring by a differential transformer. When the user gets on the footrests 3 before sitting on the saddle 22, a sum of the loads detected by the load sensors 30 provides the user's body weight. Instead of taking a standing posture on the footrests, it is also possible to estimate the user's body weight in a sitting posture. In this case, a load sensor is also located on the saddle 22. A sum of the loads detected at the pair of footrests and a load detected by the load sensor of the saddle 22 is determined as the user's body weight.

The height position of the saddle 22 is adjustable to keep the bending angle of the knee joint of the user at a required angle. Therefore, the height position of the saddle 22 (i.e., the length of the supporting member 2) can be measured by use of a distance sensor 32. The body height estimating unit 72 estimates the user's body height according to the height of the saddle 22, the angle of the knee joint and a positional relationship with the footrests. In place of the body height, the user's leg length may be estimated.

The energy expenditure operation unit 16 calculates a target energy expenditure per unit time of the user according to the user's body weight and an output of the body constitution estimating unit 6. An exercise amount applied to the user is determined as the energy expenditure such as glucose consumption. Since a posture of the user during exercise can be approximately determined, it becomes possible to estimate a load acting on the leg portion according to operation speed of the saddle 22 and the user's body weight. As in the case of the second embodiment, muscle mass of the leg portion is estimated by the body constitution estimating unit 6 with use of the user's body weight provided from the body weight estimating unit 70 and an output of the impedance measuring unit. Alternatively, the muscle mass of the leg portion may be estimated according to the user's body height provided from the body height estimating unit 72 and the output of the impedance measuring unit. Therefore, the energy expenditure such as glucose consumption per unit time can be determined by use of the load acting on the leg portion and the muscle mass of the leg portion. Instead of the target energy expenditure, an energy expenditure of the user during the exercise may be calculated. In fact, it is preferred to determine the operation speed of the saddle 22 by use of the energy expenditure calculated by the energy expenditure operation unit 16, the muscle mass estimated by the body constitution estimating unit 6, and the user's body weight determined by the body weight estimating unit 70. In this embodiment, the fat mass or both of the muscle mass and the fat mass may be used in place of the muscle mass.

Fourth Embodiment

Figure 14:
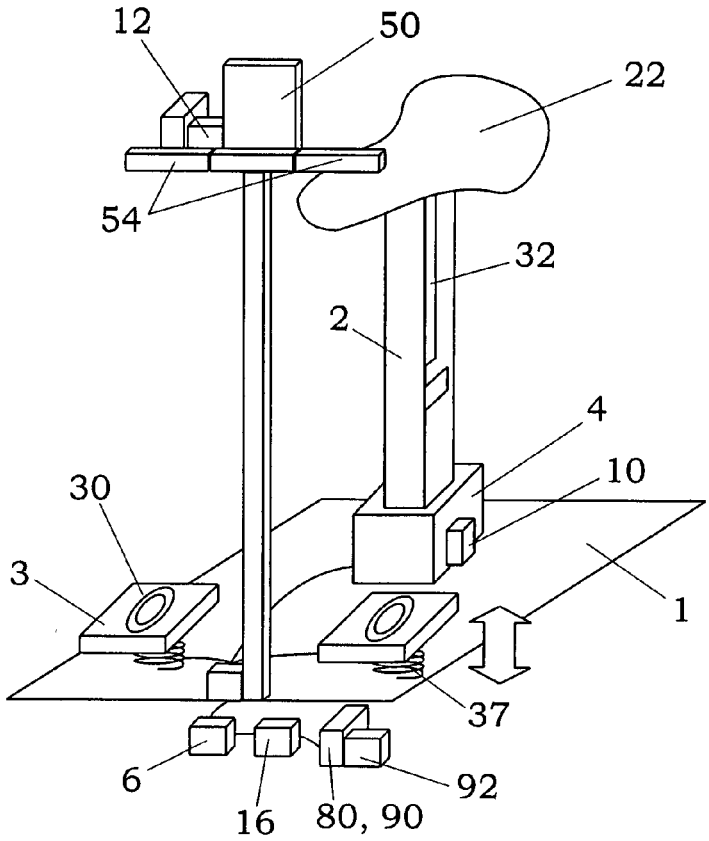
FIG. 14 is a schematic perspective view of an exercise aid device according to a fourth embodiment of the present invention.
Figure 15:
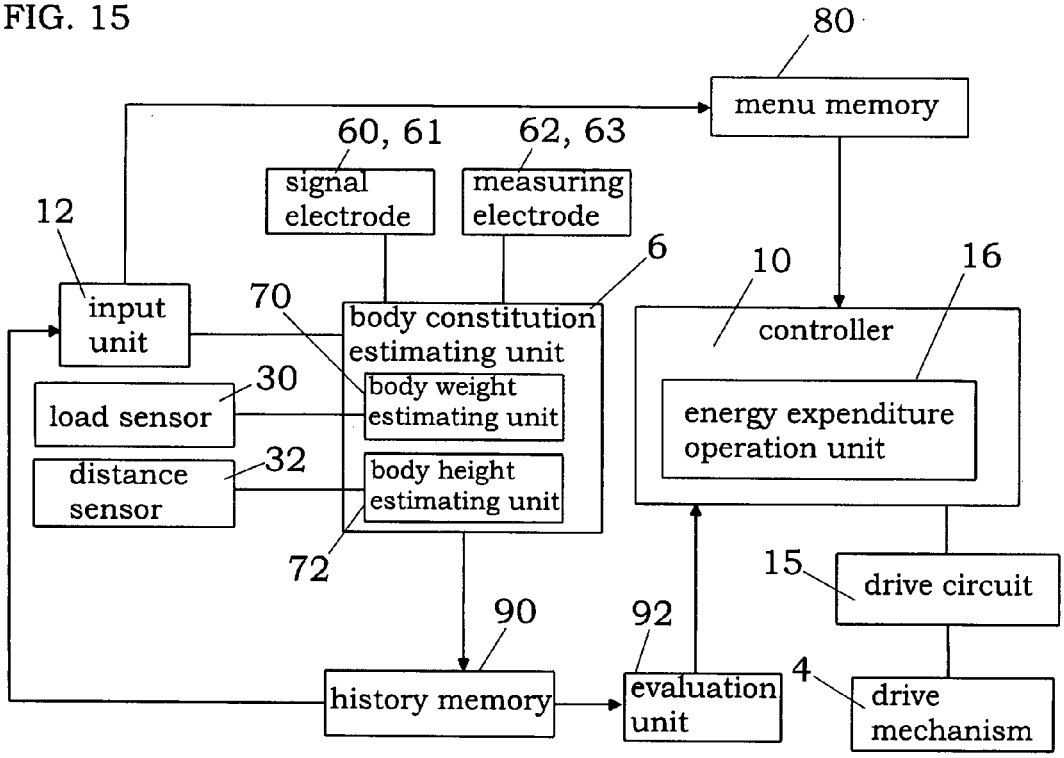
FIG. 15 is a block diagram of the exercise aid device.

As shown in FIGS. 14 and 15, an exercise aid device of the present embodiment is characterized by appropriately determining an exercise amount to be provided to the user according to a biological profile of the user input from the input unit 12. Therefore, other components are substantially the same as the third embodiment, and duplicate explanations are omitted.

The exercise aid device of this embodiment has a menu memory 80, in which a standard exercise menu is stored with each of biological profiles. According to the user's biological profile input through the input unit 12, a recommended exercise menu is read from the menu memory 80, and then executed by the controller 10.

The biological profiles comprises the user's body weight, body height, gender, age, the presence or absence of disease, the kind of disease, cardiopulmonary capacity, health parameters such as blood pressure and heartbeat, experience of sport, and so on. For example, when the user has a high-blood pressure, it is preferred to select an exercise menu with an extended exercise time and a reduced load. In this case, when the blood pressure is input, it is categorized as "low-blood pressure", "normal blood pressure" or "high-blood pressure", and then the appropriate exercise menu is extracted from the menu memory 80. Thus, it is possible to provide the appropriate exercise menu to the user by imputing the individual user data.

In addition, the exercise aid device of the present embodiment is provided with a history memory 90 for storing personal history information about a change in fat mass or muscle mass of the individual user, and an evaluation unit 92 for modifying the exercise menu according to the personal history stored in the history memory. Since the fat mass or the muscle mass is estimated every exercise, the information is stored together with the corresponding date and time. For example, a difference in fat mass between starting and finishing points of a constant time period is determined. When the difference is smaller than a predetermined target value, the evaluation unit 92 modifies the exercise menu to increase the exercise amount at one time. In place of the fat mass, the muscle mass or both of the fat mass and the muscle mass may be used. Since the exercise amount is a product of the operation speed and the operation time of the supporting member, the exercise menu can be modified by changing at least one of them. In addition, when the user needs an exercise for increasing the muscle mass, or the estimated muscle mass does not reach the target value, the exercise menu is modified to increase the exercise stress. The menu memory 80 and the history memory 90 may be provided by a single memory device. In addition, when the change in fat mass or muscle mass is shown on the display 50, which is disposed adjacent to the input unit 12, there is an advantage of increasing the user's desire to the exercise.

INDUSTRIAL APPLICABILITY

As described above, according to the exercise aid device of the present invention, it is possible to effectively provide a passive exercise stimulus with a muscle contraction of the femoral region to users with muscle weakness and patients with knee osteoarthritis and diabetes with knee pain, without placing a burden on the knee.

In addition, when estimating at least one of fat mass and muscle mass of the user, and setting exercise speed and exercise time suitable to the respective user according to the estimation result, an appropriate exercise amount for obtaining a desired effect can be provided to the user with reliability. Furthermore, when estimating the force (shearing force) acting on the knee joint of the user, and controlling the drive mechanism in a real-time manner such that the estimated force is within a predetermined range, it is possible to prevent that an excessive force acts on the user's knee, and improve the safety of the exercise aid device.

Thus, since the present invention can safely provide an appropriate exercise stimulus to leg portion of the user with knee disorder such as diabetic patients, it is expected to bring about a further increase in use of the exercise aid device.

The invention claimed is:

1. An exercise aid device comprising:

a base;

a supporting member, movable relative to said base in a forward right direction and a forward left direction, which is configured to support a hip of a user;

a footrest movable relative to said base at least in the up and down directions;

a drive means configured to drive said supporting member and at least one of said footrest and a controller configured to control said drive means such that a load acting on a femoral region by own weight of the user supported on said supporting member changes according to a relative positional displacement between the user's toe and trochanter major, said positional displacement is allowed in a direction of flexion and extension of knee joint of the user, and an angle of the knee joint is maintained substantially constant, wherein the supporting member comprises a saddle for supporting the user's hip, wherein said drive means drives said supporting member so that:

the saddle is oscillated between an upright posture relative to the base and an inclined posture in the forward right direction or the forward left direction.

2. The exercise aid device as set forth in claim 1, further comprising a body constitution estimating unit configured to estimate at least one of fat mass and muscle mass of the user, and wherein said controller controls said drive means by use of an output of said body estimation unit.

3. The exercise aid device as set forth in claim 2, further comprising a grip which is held by the user, a pair of first electrodes disposed on said footrest, a pair of second electrodes provided on said grip, and an impedance measuring unit configured to measure a bioelectrical impedance of the user by detecting a potential difference between one of said first electrodes and one of said second electrodes, while applying a high frequency current between the other first electrode and the other second electrode, under the condition that the user's foot is placed on said footrest and said grip is held by the user, and wherein said body constitution estimating unit estimates at least one of fat mass and muscle mass of the user by use of an output of said impedance measuring unit.

4. The exercise aid device as set forth in claim 3, further comprising a body weight input unit configured to input the user's body weight, and said body constitution estimating unit estimates at least one of fat mass and muscle mass of the user by use of the output of said impedance measuring unit and the user's body weight input by said body weight input unit.

5. The exercise aid device as set forth in claim 3, further comprising a body information input unit configured to input body weight and body height of the user, and an energy expenditure operation unit configured to calculate one of an energy expenditure per unit time of the user during exercise and a target energy expenditure per unit time of the user by use of an output of said body constitution estimating unit and the user's body weight and body height input by said body information input unit, and wherein said controller controls said drive means according to an output of said energy expenditure operation unit.

6. The exercise aid device as set forth in claim 3, further comprising a load sensor configured to detect a load acting on said footrest, and a body weight estimating unit configured to estimate the user's body weight by use of an output of said load sensor, and wherein said body constitution estimating unit estimates at least one of fat mass and muscle mass of the user by use of outputs of said impedance measuring unit and said body weight estimating unit.

7. The exercise aid device as set forth in claim 3, wherein said supporting member is length-adjustable in a height direction, and the exercise aid device comprises a distance sensor configured to detect the length of said supporting member in the height direction, and a body height estimating unit configured to estimate the user's body height by use of an output of said distance sensor, and wherein said body constitution estimating unit estimates at least one of fat mass and muscle mass of the user by use of outputs of said impedance measuring unit and said body height estimating unit.

8. The exercise aid device as set forth in claim 3, further comprising a memory configured to record a change in at least one of fat mass and muscle mass of the user, and an evaluation unit configured to evaluate exercise effects according to the change recorded in said memory, and wherein said controller controls said drive means by use of an output of said evaluation unit.

9. The exercise aid device as set forth in claim 1, further comprising a load sensor configured to detect a load acting on said footrest, and an operation unit configured to estimate a force acting on the knee joint of the user by use of an output of said load sensor, and wherein said controller controls said drive means in a real-time manner such that the force estimated by said operation unit is within a predetermined range.

10. The exercise aid device as set forth in claim 9, wherein said controller causes said drive means to stop when the force estimated by said operation unit exceeds a predetermined upper-limit value.

11. The exercise aid device as set forth in claim 9, wherein said controller controls an operation speed of said drive means such that the force estimated by said operation unit is within said range.

12. The exercise aid device as set forth in claim 9, further comprising a display means configured to display the force estimated by said operation unit to the user.

13. The exercise aid device as set forth in claim 1, further comprising a memory configured to record a plurality of exercise programs by biological profile, and an input unit configured to input the user's biological profile, and wherein said controller reads out from said memory one of said exercise programs which corresponds to the user's biological profile input by said input unit, and controls said drive means according to the read-out exercise program.

14. The exercise aid device as set forth in claim 1, wherein said drive means drives only said supporting member.

15. An exercise aid device comprising:

a base;

a supporting member, movable relative to said base in a forward right direction and a forward left direction, which is configured to support a hip of a user;

a footrest movable relative to said base at least in the up and down directions;

a drive means configured to drive at least one of said footrest and said supporting member; and a controller configured to control said drive means such that a load acting on a femoral region by own weight of the user supported on said supporting member changes according to a relative positional displacement between the user's toe and trochanter major, said positional displacement is allowed in a direction of flexion and extension of knee joint of the user, and an angle of the knee joint is maintained substantially constant, wherein the supporting member comprises a saddle for supporting the user's hip, wherein said drive means drives said supporting member and said footrest in an interlocking manner so that:

the saddle is oscillated between an upright posture relative to the base and an inclined posture in the forward right direction or the forward left direction.

* * * * *